US008730642B2

(12) United States Patent
Guo et al.

(10) Patent No.: US 8,730,642 B2
(45) Date of Patent: May 20, 2014

(54) STACKER AND STATIC ELIMINATION DEVICE FOR THE SAME

(71) Applicant: Shenzhen China Star Optoelectronics Technology Co., Ltd., Guangdong (CN)

(72) Inventors: Zhenhua Guo, Shenzhen (CN); Chunhao Wu, Shenzhen (CN); Kunhsien Lin, Shenzhen (CN); Yunshao Jiang, Shenzhen (CN); Minghu Qi, Shenzhen (CN); Zenghong Chen, Shenzhen (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 44 days.

(21) Appl. No.: 13/696,597

(22) PCT Filed: Oct. 12, 2012

(86) PCT No.: PCT/CN2012/082881

§ 371 (c)(1),
(2), (4) Date: Nov. 7, 2012

(87) PCT Pub. No.: WO2014/043949

PCT Pub. Date: Mar. 27, 2014

(65) Prior Publication Data

US 2014/0078638 A1 Mar. 20, 2014

(30) Foreign Application Priority Data

Sep. 20, 2012 (CN) ..... 2012 1 0351170

(51) Int. Cl.
*H05F 3/00* (2006.01)
*H05F 3/06* (2006.01)

(52) U.S. Cl.
CPC ..... *H05F 3/06* (2013.01)
USPC ..... 361/213; 361/220; 361/222

(58) Field of Classification Search
CPC ..... H05F 1/02; H05F 3/00; H05F 3/06
See application file for complete search history.

(56) References Cited

U.S. PATENT DOCUMENTS

| | | | | |
|---|---|---|---|---|
| 5,781,416 | A * | 7/1998 | Maroney | 361/800 |
| 5,808,829 | A * | 9/1998 | Lee | 360/96.51 |
| 5,950,424 | A * | 9/1999 | Nojima | 60/275 |
| 2008/0190294 | A1 * | 8/2008 | Sato et al. | 96/63 |
| 2009/0116162 | A1 * | 5/2009 | Onezawa et al. | 361/213 |

* cited by examiner

*Primary Examiner* — Jared Fureman
*Assistant Examiner* — Terrence Willoughby
(74) *Attorney, Agent, or Firm* — Andrew C. Cheng

(57) ABSTRACT

This invention provides a stacker with static elimination devices arranged at both sides of each shelf of the stacker and comprises a rectangular box producing charged ions. A rotary shaft is connected with the rectangular box and with both ends fixed on upper and lower shelf holders, respectively. A standpipe parallel with the rotary shaft is provided inside the rectangular box and includes a horizontal transverse plate on which an ion generator is installed. The standpipe includes a blowing device directing charged ions generated toward a cartridge transferred in and out of the shelf. With the static elimination devices at both sides of each shelf of the stacker, the charged ions are blown toward glass substrates disposed inside the cartridge transferred in and out of the shelf to eliminate the static of the glass substrate inside the cartridge and improve the yield.

18 Claims, 4 Drawing Sheets

STACKER AND STATIC ELIMINATION DEVICE FOR THE SAME

This application claims priority to Chinese Patent Application Serial No. 201210351170.5, named as "stacker and static elimination device for the same", filed on Sep. 20, 2012, the specification of which is incorporated herein by reference.

BACKGROUND OF THE INVENTION

1. Field of the Invention

The present invention relates to a liquid crystal panel production technology, and in particular to a stacker and a static elimination device for the same.

2. The Related Arts

In display panel, especially in the production factory of the OLED (Organic Light-Emitting Diode) panel, static is a critical influence factor in the production yield of the panel. Therefore, it is needed to control and eliminate the static effectively in every process of production lines.

Stackers are important equipments within the automated panel production processes. Controlling and eliminating static effectively plays an important role in improving product yield. At present, various types of stackers don't have device for eliminating static, which is still acceptable for the static problem of the original TFT-LCD production lines. But if those stackers are used directly in the OLED production, the production yield will be affected by static problem.

SUMMARY OF THE INVENTION

To solve the technical issue in the known technology, the present invention provides a stacker which can effectively eliminate the static on the glass substrate and a static elimination device for stacker.

The present invention provides a static elimination device for stacker, wherein the static elimination device is provided at both sides of each shelf of the stacker, comprising: a rectangular box which can produce charged ions, the surface of the rectangular box provided with a long strip slit; wherein a rotary shaft is provided through and connected with the rectangular box, and both ends of the rotary shaft are respectively fixed on upper and lower shelf holders respectively; a standpipe provided inside the rectangular box and used for air intake, the vertical direction of the standpipe provided with a horizontal transverse plate, the horizontal transverse plate vertically provided with an ion generator used to generate and release the charged ions; a blowing device provided on the standpipe, the blowing device blowing the charged ions generated and released from the ion generator into and out of a cartridge of the shelf through the long strip slit which is provided on the surface of the rectangular box, to eliminate the static electricity of a glass substrate in the cartridge.

Wherein, the static elimination device further comprises a pulley connected with the rotary shaft, the pulley is provided with a driver to drive the pulley and then rotates the rotary shaft.

Wherein, the driver is a servo motor.

Wherein, the static elimination device further comprises power wires connected with the standpipe and the horizontal transverse plate, which supplies power to the blowing device and the ion generator respectively.

Wherein, the blowing device is an air blower, and the ion generator is a discharging needle.

Wherein, the standpipe is parallel with the rotary shaft, the horizontal transverse plate provided on the vertical direction of the standpipe is multilayer, and each layer of the horizontal transverse plate is provided with the discharging needle.

Correspondingly, the present invention provides a stacker, comprising: multiple shelves, a crane, and a fork; wherein both sides of each said shelf are provided with a static elimination device, and the static elimination device comprises: a rectangular box which can produce charged ions, the surface of the rectangular box provided with a long strip slit; wherein a rotary shaft is provided through and connected with the rectangular box, and both ends of the rotary shaft are fixed on upper and lower shelf holders respectively; a standpipe provided inside the rectangular box and used for air intake, the vertical direction of the standpipe provided with a horizontal transverse plate, the horizontal transverse plate vertically provided with an ion generator used to generate and release the charged ions; a blowing device provided on the standpipe, the blowing device blowing the charged ions generated and released from the ion generator into and out of a cartridge of the shelf through the long strip slit which is provided on the surface of the rectangular box, to eliminate the static electricity of a glass substrate in the cartridge.

Wherein, the static elimination devices provided at both sides of each said shelf rotate in opposite directions.

Wherein, the static elimination device further comprises a pulley connected with the rotary shaft, and the pulley is provided with a driver to drive the pulley and then rotates the rotary shaft.

Wherein, the driver is a servo motor.

Wherein, the static elimination device further comprises power wires connected with the standpipe and the horizontal transverse plate, which supplies power to the blowing device and the ion generator respectively.

Wherein, the blowing device is an air blower, and the ion generator is a discharging needle.

Wherein, the standpipe is parallel with the rotary shaft, the horizontal transverse plate provided on the vertical direction of the standpipe is multilayer, and each layer of the horizontal transverse plate is provided with the discharging needle.

The beneficial effects according to the present invention: first of all, the static elimination device can effectively eliminate the static on the glass substrate, especially for the OLED production, the product yield can be improved significantly. Secondly, the static elimination device can rotate in the designated angle and the designated direction and spray the charged ions without blind spots and dead ends. Thirdly, the airflow of clean room will not interfere with the static elimination device. And the effective contact between the charged ions and the glass substrate will not be reduced due to the shelter of the shelf holders. Furthermore, the static elimination device can be installed quickly and easily on the shelf holders, which is easy maintenance, low cost, and available to eliminate the static in any kinds of cartridge and the glass substrate provided within the same.

BRIEF DESCRIPTION OF THE DRAWINGS

To make the technical solution of the embodiments according to the present invention clear, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort.

DETAILED DESCRIPTION OF THE PREFERRED EMBODIMENTS

To solve the technical issue in the known technology, the present invention provides a static elimination device for stacker and a stacker comprising the same.

In order to make technical staffs having ordinary skills in the art have an overall understanding of the present invention, the embodiment according to the present invention provides a stacker comprising static elimination device.

Figure 1:
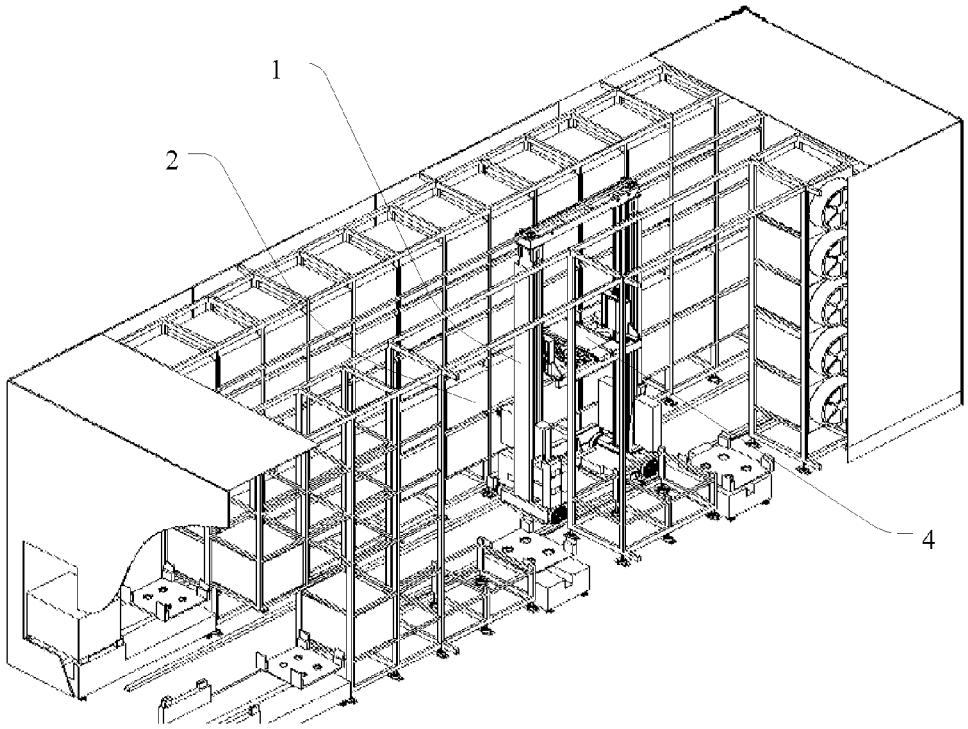
FIG. 1 is a schematic view illustrating the structure of a stacker according to the present invention.

FIG. 1 is a schematic view illustrating the structure of a stacker according to the present invention. As shown in FIG. 1, the stacker according to the present invention comprises multiple a crane 1, shelves 2, and a fork 4. The crane 1 transports the large-size glass substrate within the cartridge from outside to the shelves 2 by the fork 4 and then into the pipeline transmission.

Figure 2:
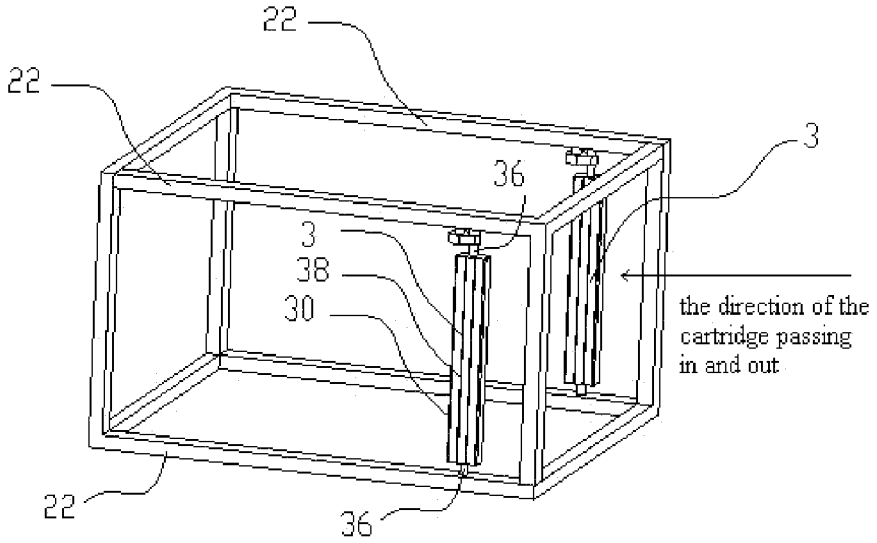
FIG. 2 is a schematic view illustrating the structure of a static elimination device provided on the shelf of the stacker according to the present invention.

Referring to FIG. 2, the shelve 2 is cuboid structure composed by shelf holders 22. There are two static elimination devices 3 provided between the upper and lower shelf holders 22, that is, two static elimination devices 3 provided corresponding to each other on the shelve 2, and a space available for the cartridge passing in and out is formed in between. In this way, when the cartridge is placed to or removed from the shelves 2 using the fork 4 by the crane 1 of the stacker, the static elimination devices 3 will blow out the charged ions to eliminate the static electricity of a glass substrate in the cartridge to improve the quality of the products.

Figure 3:
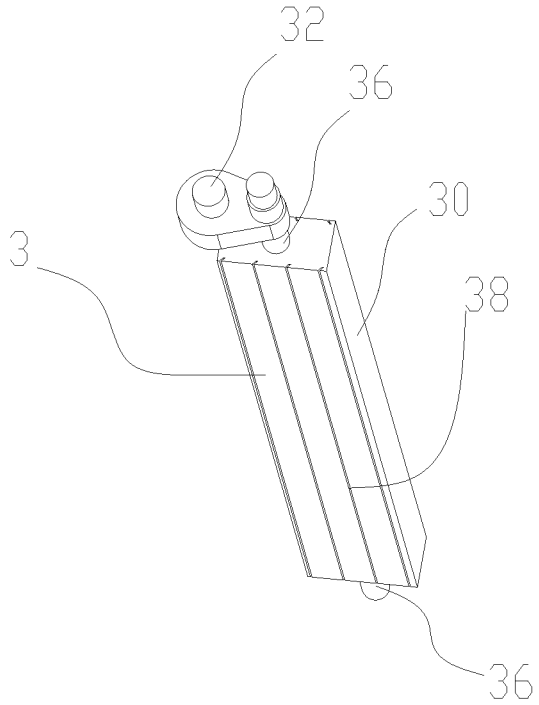
FIG. 3 is a schematic view illustrating the structure of a static elimination device for stacker according to the present invention.

Referring to FIG. 3, the static elimination device 3 comprises a rectangular box 30 which can produce charged ions. The surface of the rectangular box 30 provided with a long strip slit 38. The charged ions generated inside the rectangular box 30 can be blown out through the long strip slit 38. A rotary shaft 36 is provided through and connected with the rectangular box 30, and both ends of the rotary shaft 36 extend along the top and bottom surfaces of the rectangular box 30 and are fixed on upper and lower shelf holders 22 respectively. On the top surface of the rectangular box 30, a driver (not shown in FIG. 3) is connected with the rotary shaft 36 through a pulley 32, and then adjusts the rotation direction of the rotary shaft 36 through transmitting the belt. When the rotary shaft 36 rotates left or right, the rectangular box 30 can rotate left or right in a designated angle corresponding to the shelf holder 22, which expands the reach of the charged ions to eliminate the static on the glass substrate in greater angle.

Figure 4:
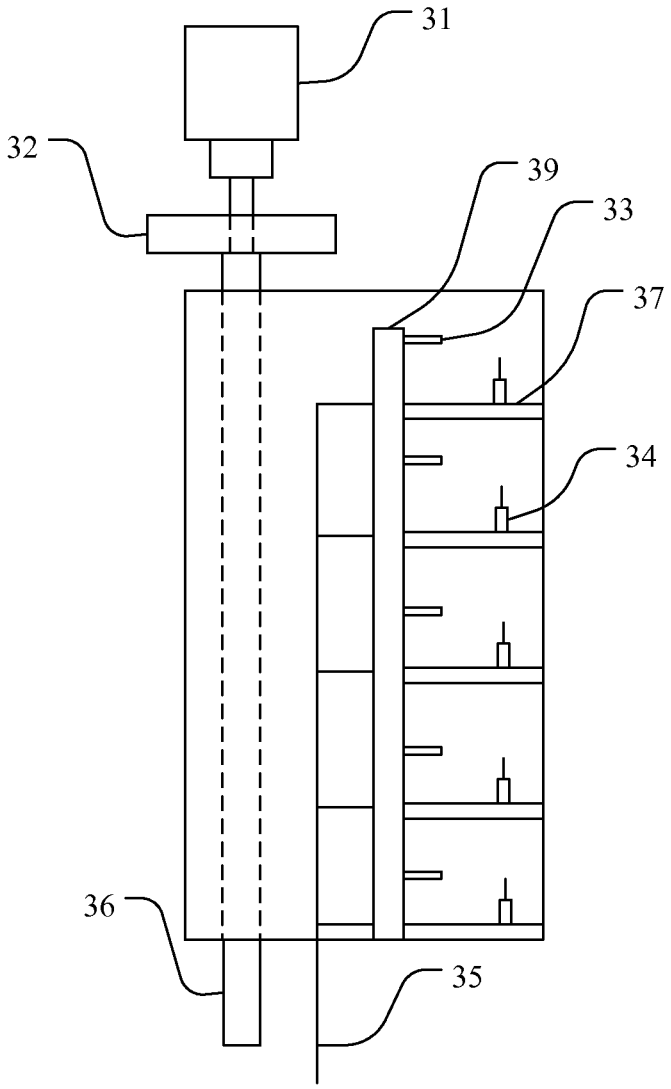
FIG. 4 is a schematic view illustrating the internal structural of the static elimination device for stacker according to the present invention.

Referring to FIG. 4, it is a schematic view illustrating the internal structural of the static elimination device 3. A standpipe 39 parallel with the rotary shaft 36 used for air intake is provided inside the rectangular box 39. The vertical direction of the standpipe 39 is provided with a horizontal transverse plate 37. The horizontal transverse plate 37 is vertically provided with an ion generator 34 used to generate the charged ions. In the present embodiment, the ion generator 34 is a discharging needle. A blowing device 33 is also provided on the standpipe 39 at the height corresponding to the ion generator 34, which blows the charged ions out the rectangular box 30 through the long strip slit 38. In the present embodiment, the blowing device 33 is an air blower. Power wires 35 are connected with the standpipe 39 and the horizontal transverse plate 37, which supplies power to the blowing device 34 and the ion generator 33 respectively. The pulley 32 is connected with the rotary shaft 36. The pulley 32 is provided with a driver 31. In the present embodiment, the driver 31 is a servo motor.

Figure 5:
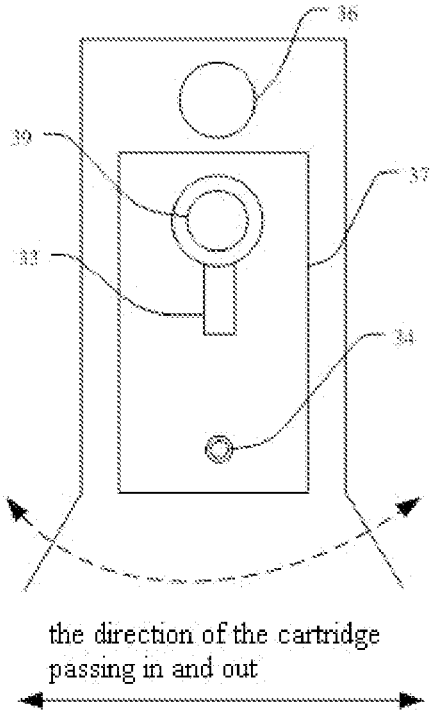
FIG. 5 is a schematic view illustrating the structure of the static elimination device for stacker rotating along the access direction of the cartridge.

It is shown as FIG. 5 while working. After the servo motor 31 receives the rotating message, it drives the pulley 32 to rotate and then adjust the rotation direction of the shaft 36 through transmitting the belt. Because the shaft 36 is fixed and connected with the rectangular box 30, the static elimination devices 3 will be driven to rotate in a certain angle while the cartridge passes in and out. The angle is in the ranges from 0 to 90 degree, specifically be 30 degree, 40 degree or 90 degree. At the same time, switch on the power lines 35, the compressed air is injected into the standpipe 39 and blew out the blowing device 33, which blows the charged ions generated from the discharging needle 34 into the cartridge through the long strip slit 38. The two static elimination devices 3 provided at both sides of the shelf holder 22 rotate in opposite directions, which eliminates the static of the glass substrate inside the cartridge in full range to improve the efficiency of static elimination. In addition, because the cartridge is multilayer structure, the vertical direction of the standpipe 39 can be further provided with a horizontal transverse plate 37. In this way, the charged ions generated from the discharging needle 34 on each layer of the horizontal transverse plate 37 can be blew to each layer of glass substrate inside the cartridge, which improves the efficiency of static elimination.

From the above, the embodiment according to the present invention discloses a stacker and a static elimination device for the same, which has the beneficial effects as follows: first of all, the static elimination device 3 can effectively eliminate the static on the glass substrate, especially for the OLED production, the product yield can be improved significantly. Secondly, the static elimination device 3 can rotate in the designated angle and the designated direction and spray the charged ions without blind spots and dead ends. Thirdly, the airflow of clean room will not interfere with the static elimination device 3. And the effective contact between the charged ions and the glass substrate will not be reduced due to the shelter of the shelf holders 22. Furthermore, the static elimination device 3 can be installed quickly and easily on the shelf holders 22, which is easy maintenance, low cost, and available to eliminate the static in any kinds of cartridge and the glass substrate provided within the same.

The preferred embodiments of the present invention have been described, but not intending to impose any unduly constraint to the appended claims. For those having ordinary skills in the art, any deduction or modification according to the present invention is considered encompassed in the scope of protection defined by the claims of the present invention.

What is claimed is:

1. A static elimination device for stacker, wherein the static elimination device is provided at both sides of each shelf of the stacker, comprising:

a rectangular box which can produce charged ions, the surface of the rectangular box provided with a long strip slit; wherein a rotary shaft is provided through and connected with the rectangular box, and both ends of the rotary shaft are fixed on upper and lower shelf holders respectively;

a standpipe provided inside the rectangular box and used for air intake, the vertical direction of the standpipe provided with a horizontal transverse plate, the horizontal transverse plate vertically provided with an ion generator used to generate and release the charged ions;

a blowing device provided on the standpipe, the blowing device blowing the charged ions generated and released from the ion generator into and out of a cartridge of the shelf through the long strip slit which is provided on the surface of the rectangular box, to eliminate the static electricity of a glass substrate in the cartridge.

2. The static elimination device for stacker as claimed in claim 1, wherein the static elimination device further comprises a pulley connected with the rotary shaft, the pulley is provided with a driver to drive the pulley and then rotates the rotary shaft.

3. The static elimination device for stacker as claimed in claim 2, wherein the driver is a servo motor.

4. The static elimination device for stacker as claimed in claim 2, wherein the static elimination device further comprises power wires connected with the standpipe and the horizontal transverse plate, which supplies power to the blowing device and the ion generator respectively.

5. The static elimination device for stacker as claimed in claim 4, wherein the blowing device is an air blower, and the ion generator is a discharging needle.

6. The static elimination device for stacker as claimed in claim 5, wherein the standpipe is parallel with the rotary shaft, the horizontal transverse plate provided on the vertical direction of the standpipe is multilayer, and each layer of the horizontal transverse plate is provided with the discharging needle.

7. A static elimination device for stacker, wherein the static elimination device is provided at both sides of each shelf of stacker, comprising:

a rectangular box which can produce charged ions, the surface of the rectangular box provided with a long strip slit; wherein a rotary shaft is provided through and connected with the rectangular box, and both ends of the rotary shaft are fixed on upper and lower shelf holders respectively;

a standpipe provided inside the rectangular box and used for air intake, the vertical direction of the standpipe provided with a horizontal transverse plate, the horizontal transverse plate vertically provided with an ion generator used to generate and release the charged ions;

a blowing device provided on the standpipe, the blowing device blowing the charged ions generated and released from the ion generator into and out of a cartridge of the shelf through the long strip slit which is provided on the surface of the rectangular box, to eliminate the static electricity of a glass substrate in the cartridge;

wherein the static elimination device further comprises a pulley connected with the rotary shaft, and the pulley is provided with a driver to drive the pulley and then rotates the rotary shaft.

8. The static elimination device for stacker as claimed in claim 7, wherein the driver is a servo motor.

9. The static elimination device for stacker as claimed in claim 7, wherein the static elimination device further comprises power wires connected with the standpipe and the horizontal transverse plate, which supplies power to the blowing device and the ion generator respectively.

10. The static elimination device for stacker as claimed in claim 9, wherein the blowing device is an air blower, and the ion generator is a discharging needle.

11. The static elimination device for stacker as claimed in claim 10, wherein the standpipe is parallel with the rotary shaft, the horizontal transverse plate provided on the vertical direction of the standpipe is multilayer, and each layer of the horizontal transverse plate is provided with the discharging needle.

12. A stacker, comprising: multiple shelves, a crane, and a fork; wherein both sides of each said shelf are provided with a static elimination device, and the static elimination device comprises:

a rectangular box which can produce charged ions, the surface of the rectangular box provided with a long strip slit; wherein a rotary shaft is provided through and connected with the rectangular box, and both ends of the rotary shaft are fixed on upper and lower shelf holders respectively;

a standpipe provided inside the rectangular box and used for air intake, the vertical direction of the standpipe provided with a horizontal transverse plate, the horizontal transverse plate vertically provided with an ion generator used to generate and release the charged ions;

a blowing device provided on the standpipe, the blowing device blowing the charged ions generated and released from the ion generator into and out of a cartridge of the shelf through the long strip slit which is provided on the surface of the rectangular box, to eliminate the static electricity of a glass substrate in the cartridge.

13. The stacker as claimed in claim 12, wherein the static elimination devices provided at both sides of each said shelf rotate in opposite directions.

14. The stacker as claimed in claim 13, wherein the static elimination device further comprises a pulley connected with the rotary shaft, and the pulley is provided with a driver to drive the pulley and then rotates the rotary shaft.

15. The stacker as claimed in claim 13, wherein the driver is a servo motor.

16. The stacker as claimed in claim 15, wherein the static elimination device further comprises power wires connected with the standpipe and the horizontal transverse plate, which supplies power to the blowing device and the ion generator respectively.

17. The stacker as claimed in claim 16, wherein the blowing device is an air blower, and the ion generator is a discharging needle.

18. The stacker as claimed in claim 17, wherein the standpipe is parallel with the rotary shaft, the horizontal transverse plate provided on the vertical direction of the standpipe is multilayer, and each layer of the horizontal transverse plate is provided with the discharging needle.

* * * * *